US005588825A

United States Patent [19]

Kostiuk et al.

[11] Patent Number: 5,588,825

[45] Date of Patent: Dec. 31, 1996

[54] LEAN PREMIXED FUEL BURNER

[75] Inventors: Larry W. Kostiuk, Edmonton; Matthew R. Johnson, Antigonish, both of Canada

[73] Assignee: Governers of the University of Alberta, Edmonton, Canada

[21] Appl. No.: 572,269

[22] Filed: Dec. 13, 1995

[51] Int. Cl.[6] ..... F23D 14/58

[52] U.S. Cl. ..... 431/349; 431/328; 431/350; 239/552; 239/553.5; 239/590.5

[58] Field of Search ..... 431/8.9, 326, 327, 431/328, 350, 349, 116, 115; 60/749; 239/552, 553, 553.5, 590.1, 590.3, 590.5

[56] References Cited

U.S. PATENT DOCUMENTS

| | | | |
|---|---|---|---|
| 686,625 | 11/1901 | Machlet, Jr. | 431/349 |
| 3,817,690 | 6/1974 | Bryce | 431/350 |
| 4,397,631 | 8/1983 | Fisher . | |
| 4,869,230 | 9/1989 | Fletcher . | |
| 5,236,327 | 8/1993 | Flanagan et al. . | |
| 5,326,257 | 7/1994 | Taylor et al. . | |
| 5,447,427 | 9/1995 | Suzuki . | |

FOREIGN PATENT DOCUMENTS

| | | | |
|---|---|---|---|
| 152307 | 11/1980 | Japan | 431/349 |
| WO95/09326 | 4/1995 | WIPO . | |

OTHER PUBLICATIONS

Low $NO_x$ Production through Lean Burn Premixed Combust Johnson et al American Flame Research Committee Apr. 1994.

Lean Burn Technology for Gas Appliances Johnson & Kostiuk Canadian Conference of Applied Mechanics May 28 to Jun. 1, 1995.

*Primary Examiner*—James C. Yeung

*Attorney, Agent, or Firm*—C. A. Rowley

[57] ABSTRACT

A lean premixed fuel burner includes a peripheral ring stabilizer which divides the flow into a primary gas flow and a secondary gas flow and generates a secondary flame substantially surrounding the main flame formed by the main gas flow. Further stabilizers are provided in the area of the primary gas flow on the inside of the peripheral stabilizer. These stabilizers divide the main gas flow into a plurality of subsidiary flows whereby the primary flame is formed by a plurality of discrete flame formed in the spaces between the secondary stabilizers thereby to provide a main flame significantly shorter in the direction of gas flow than if a single primary flame is used.

9 Claims, 4 Drawing Sheets

LEAN PREMIXED FUEL BURNER

FIELD OF THE INVENTION

The present invention relates to premixed lean gas fuel burner, more particularly, the present invention relates to a premixed lean gas fuel burner having relatively short main flame.

BACKGROUND OF THE INVENTION

As is well known, the use of lean premixed fuels in burners result in the production of a significantly lower amount of oxides of nitrogen ($NO_x$) and many attempts have been made to provide lean premixed fuel burner capable of burning lean premixed fuels. The term lean fuel mixture or lean premixed fuel as used herein is intended to mean a fuel mixture having an equivalence ratio of less than unity (1), preferably less than 0.75, and the term equivalence ratio means actual fuel to air (oxidant) weight ratio divided by the stoichiometric fuel to air weight ratio. Obviously if another oxidant containing gases are used in place of air the equivalence ratio will change accordingly.

The use of lean fuel mixtures results in a lower flame temperature which may be reduced to a temperature at which the rate of $NO_x$ produced is small thereby lowering the $NO_x$ emissions while still generating a significant amount of heat.

One of the major problems encountered when burning a lean premixed fuel and oxidant mixture is flame instability and thus, which results in the flame being easily put out for example by being blown out, thereby rendering such systems defective.

WO95/09326 published Apr. 6, 1995, inventor Meijer et al. discloses one form of burner for burning the lean premixed fuel mixture by simply inducing more air at the base of the flame so that the fuel mixture leaving the nozzle or gun of the burner, may have a low equivalency ratio but this ratio is significantly increased by the air induced at the flame base to thereby maintain stability of the flame i.e. in the flame the equivalency ratio is or closely approaches 1. Meijer et al. provides stabilizer bridges across the nozzle outlets to help to maintain the stability of the individual flames which burn one directly above each stabilizer bridge.

It is also known to stabilize the periphery of a lean premixed fuel burner as described, for example, in the publication "Low $NO_x$ Production Through Lean Premixed Combustion" by Johnson et al. presented at the American Planning Research Committee on April 1994 and "Lean Burn Technology for Gas Appliances" by Johnson and Kostiuk, presented at the Canadian Conference of Applied Mechanics—May 28 to Jun. 1, 1995 which describe a burner having a peripheral ring stabilizer and the effective burning of lean fuel mixtures. In this system it has been found that the main flame extends from the nozzle outlet a very substantial distance in the order of (28 cm for a 3.2 cm diameter burner nozzle burning fuel with an equivalence ratio of 0.7) which makes the device difficult and, in fact, in many cases unsuitable as a replacement into conventional burner as the flame is too long.

It is also known to use in a conventional air fuel burner (as opposed to a lean fuel burner) to burn the premixed fuel within a ceramic cavity and to contain the burning fuel within the cavity by a screen mesh or the like extending across the side of the cavity remote from the where the fuel is injected. Such a system is shown in U.S. Pat. No. 5,326,257 issued Jul. 5, 1994 to Taylor et al.

It is also known to apply a screen over a Bunsen burner or the like (i.e. for fuel mixtures with an equivalency ratio above 1) which breaks up the flame into a plurality of flames. These screens are not used as flame stabilizers but only function as stabilizers on the principal of the screen forming a heat sink at a temperature above the auto ignition temperature of the fuel mixture. This is dangerous as it may cause the flame to propagate backwards in the direction of fuel flow on the upstream side of the screen., i.e. burning back through the fuel system which is dangerous.

U.S. Pat. No. 5,447,427 issued Sep. 5, 1995 to Suzukli burns a low calorific gas in burner that receives the premixed fuel through a refractory baffle that is heated to a high temperature and sustains the burning of the low calorific gas in the recirculation zones on the downstream side of the refractory baffle.

U.S. Pat. No. 4,397,631 issued Aug. 9, 1983 to Fisher discloses a burner for premixed power gas wherein a burner plate of defined thickness and having a selected pattern of holes of selected size is used to prevent flashback and noise or screech while also improving flame stability.

U.S. Pat. No. 5,236,327 Issued Aug. 17, 1993 to Flanagan et al. discloses a burner for premixed lean gas mixture by reducing the time the combustion gases are in the flame zone by increasing the velocity of the fuel mixture and incorporates a flame stabilizer using a buff or blunt body in the premixed fuel passage to cause turbulence on its downstream side and tends to prevent the flame from "lifting off" due to the high gas velocities used. The flame length or height generated by this type of burner is very long.

BRIEF DESCRIPTION OF THE PRESENT INVENTION

It is an object of the present invention to provide an effective burner for burning lean premixed fuel mixtures while controlling the flame length to the length desire e.g. a length similar to that obtained in conventional burner.

Broadly, the present invention relates to a burner for burning a flow of premix lean gaseous fuel mixtures having an equivalence ratio of less than one comprising a nozzle having an outer periphery, an outer ring stabilizer means positioned within said outer periphery and spaced from said periphery to divide said flow of gaseous fuel mixture into a primary flow and a secondary flow, said secondary flow being adjacent to said periphery and being significantly less than said primary flow, flame dividing stabilizer means dividing said primary flow into a plurality of discrete subsidiary flows, each of said subsidiary flows forming a subsidiary flame having a base dimension correlated with the desired maximum height of its subsidiary flame, said flame dividing stabilizer means having at least one stabilizer element arranged to define spaces through which said subsidiary flows pass and that correspond with and define said base dimensions of said subsidiary flame immediately downstream thereof, each said ring and said flame stabilizer elements having a blunt cross sectional shape to generate recirculating flows of hot product gases that extend across its downstream end, said recirculating flows continually igniting its adjacent subsidiary flows to stabilize its adjacent said flames.

Preferably, said at least one stabilizer element will comprise at least one stabilizer bar extending transversely of said primary flow and dividing said primary flow into said subsidiary flows.

Preferably, said at least one stabilizer element will comprise at least one annular stabilizer ring element concentric with said outer stabilizer means and dividing said primary flow into at least two subsidiary flows.

Preferably, said at least one stabilizer element will comprise a plurality of stabilizer bar arranged in a pattern.

Preferably, said pattern will be defined by at least one pair of said stabilizer bars intersecting.

Preferably, said stabilizer bars intersect adjacent to the midpoint of said primary flow.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
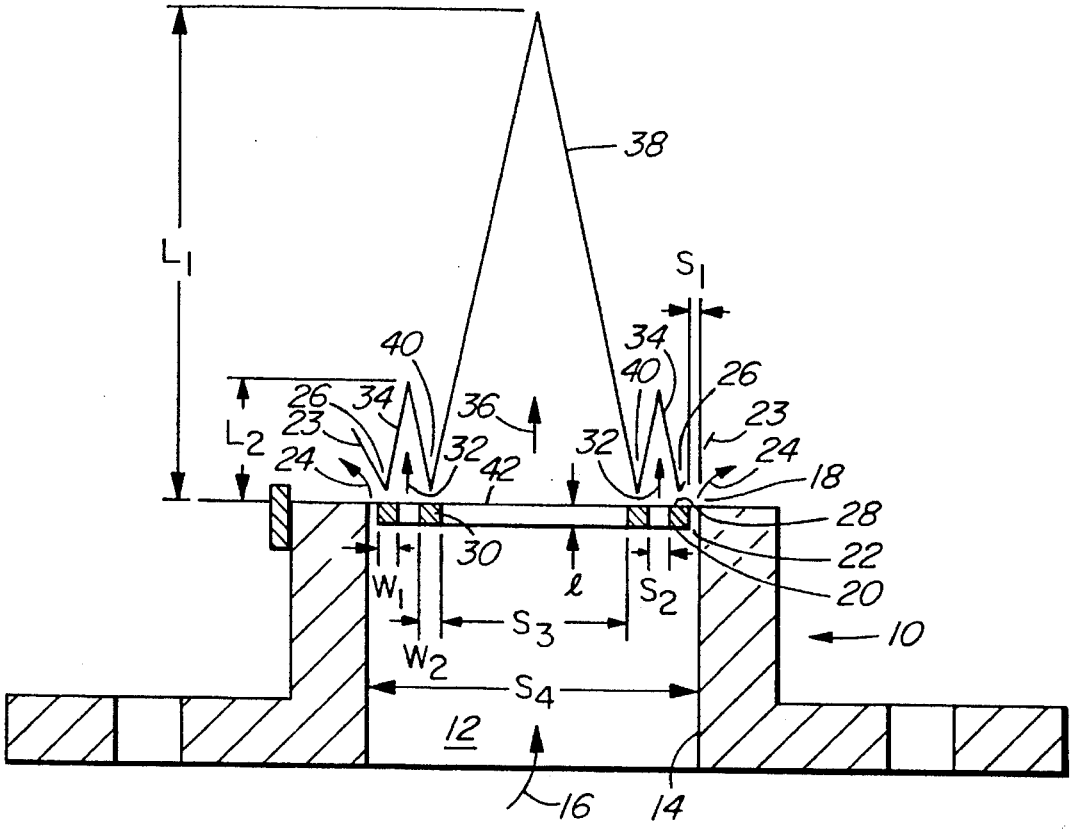
FIG. 1 is a section through a burner employing concentric ring stabilizers.

Referring to FIG. 1, it is shown a burner 10 having bore or nozzle passage 12 defined by a peripheral wall 14 and into which a premixed gaseous lean gas (e.g. air fuel mixture) is introduced as schematically represented by the arrow 16.

Adjacent to the outlet end 18 of the passage 12 is a peripheral ring stabilizer 20 which is preferably uniformly spaced from the periphery 14 of the bore 12 by a spacing indicated at $S_1$, a gas flow schematically represented by the arrow 24 passes through the space 22 between the ring 20 and the periphery 14 of the passage 12 and supports the flame 23.

The distance $S_1$ (see FIGS. 1 and 4) between the inner periphery 14 of the burner 10 and the outer periphery of the stabilizer 20 is small yet sufficient to pass enough lean fuel mixture to generate, in combination with the stabilizer 20, recirculation of hot product gases in the area 26 immediately downstream end 28 of the stabilizer 20.

Figure 3:
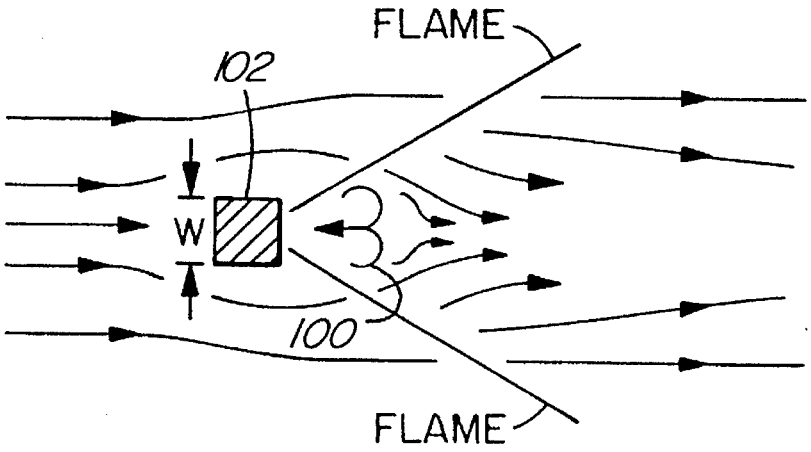
FIG. 3 is an enlarged cross sectional view of a stabilizer element used in the present invention illustrating the operation of the recirculating flow to continuously ignite the adjacent flames.
Figure 4:
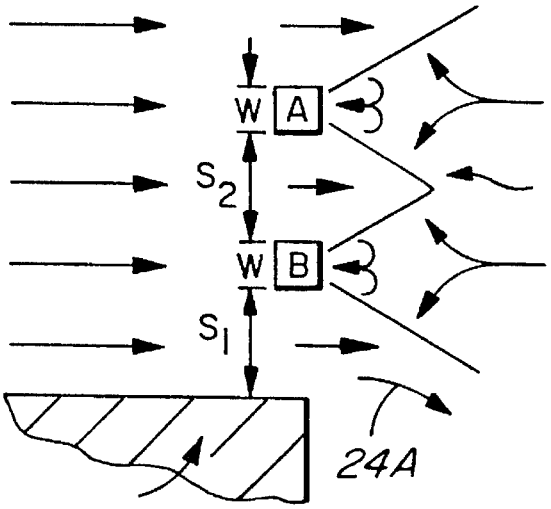
FIG. 4 is a view similar to FIG. 3 showing the effect of adjacent stabilizer elements and the outer ring stabilizer element.

This recirculation as shown in FIGS. 3 and 4 -provides a continual stable ignition source of the lean premixed fuel in the area 26 and insures the flame(s) produced by the primary flow within the ring 20 extend to substantially the full periphery of the burner. It has been found that the dimension $S_1$ should not be less than about 0.5 mm as, if the flow through the space defined by the distance $S_1$ is too small, the recirculation of hot gases will not be formed to stabilize the flame in the area 26 and proper burning will not be sustained.

Flow 24 of lean premixed fuel between the inner periphery 14 of burner 10 and the stabilizer 20 is only partially burned by the flame 23, thus any flow exceeding that required to sustain the recirculation of the hot gases in the area 26 is potentially wasted. Therefore, this dimension $S_1$ should be maintained as small as possible but sufficient to maintain the recirculation in the area 26 and to stabilize the flames adjacent to the periphery of the passage 12 without requiring overheating of the main nozzle or body portion of the nozzle 10 adjacent to the outlet 18 as is required in conventional burners not equipped with an outer ring stabilizer 20.

Figure 2:
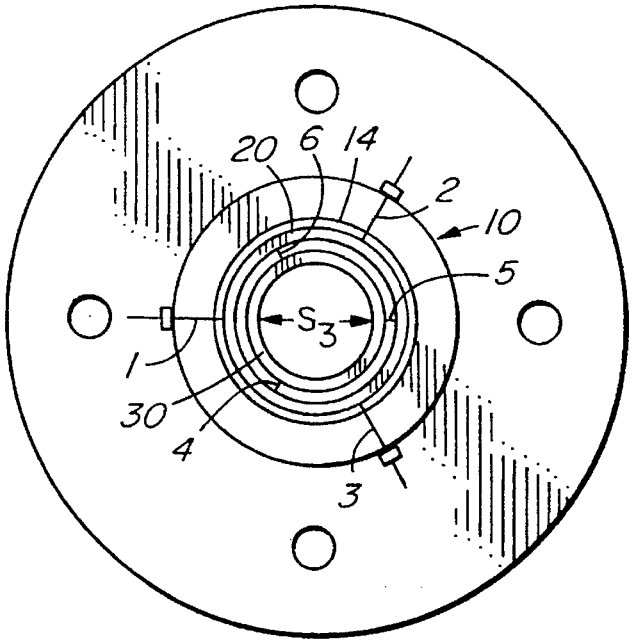
FIG. 2 is a plan view looking down at the top of the burner shown in FIG. 1.

In the FIGS. 1 and 2 embodied a second ring stabilizer 30 concentric with the outer ring stabilizer or peripheral ring stabilizer 20 but spaced therefrom by distance $S_2$ divides the main or principal flow (within the ring 20) into a first subsidiary flow represented by the arrow 32 and a second subsidiary flow represented by the arrow 36. The first subsidiary flow 32 is in the form of an annular flow between the two stabilizer rings 20 and 30 and propagates a first component flame 34. The second subsidiary flow 36 passes through the inner circumference of the ring 30 forms a second component flame 38 which is supported by an area having a diameter $S_3$. The height or length of the component flames are dependent on their base dimensions (defined by the spacing of the stabilizers) The maximum diameter of the inner flow 36 is significantly wider than the width $S_2$ for passage of the flow 32, for this reason, the flame 38 has a length in the axial direction (direction of flow of the gaseous fuel) as indicated by the dimension $L_1$ significantly longer than the length of $L_2$ of the flame 34 since the base dimension of the flame 38 is determined by the distance $S_3$ and for the flame 34 is the distance $S_2$ and the dimension $S_3$ is significantly larger than $S_2$.

In the illustrated arrangement, each of the stabilizer rings 20 and 30 has a length l measured in the direction of gas flow and a width indicated as $W_1$ for the peripheral stabilizer 20 and $W_2$ for the inner stabilizer ring 30. The length l is not critical and the width $W_1$ and $W_2$ must be sufficient to generate a recirculation of hot gases in the area 26 immediately downstream of the stabilizer 20 and in the area 40 immediately downstream of the downstream end 42 of the stabilizer ring 30 to continually ignite and anchor the flames 23, 34 and 38.

Obviously, the width $W_1$ and $W_2$ tend to obstruct flow of the lean premixed fuel mixture and thus preferably are no wider than that required to generate a recirculation of hot gas to ignite the flows 24 and 32 and flows 32 and 36 and thereby provide areas of hot gases 26 and 40 for the flames 23, 34 and 38.

It has been found that a stabilizer width W such as the widths $W_1$ or $W_2$ of about 2 mm functions well as does a length l of approximately 2 mm.

As above indicated, if the width W (see FIGS. 3 and 4) of a stabilizer element is too large, it unduly obstructs the flow and may not generate the recirculation (represented by the arrows 100 in FIG. 3) of hot gases from the adjacent flames and continually ignite the two adjacent gas streams. If the width W of a stabilizer element is too narrow recirculation of hot gases of sufficient magnitude to ignite the adjacent flows may not be formed.

It will be apparent that in all cases, the stabilizer element functions by generating a recirculation of hot gases of combustion products as indicated at 100 on the downstream side of the stabilizer that continually ignites and interconnects the adjacent flows with flames. All of the stabilizer elements described in this application (ring or bar or rod type) function in essentially the same manner.

Figure 5:
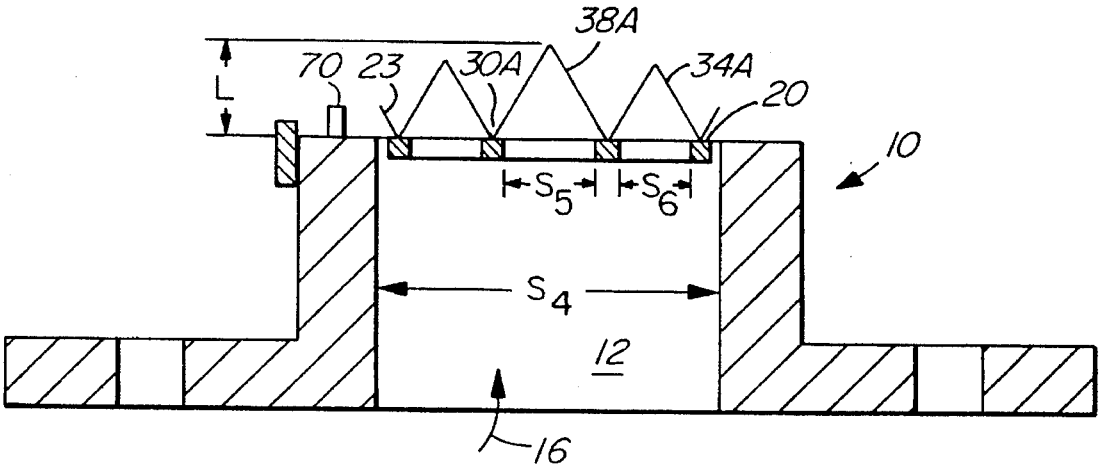
FIG. 5 is a burner similar to FIG. 1 but wherein the inner concentric ring stabilizer is spaced farther from the outer ring stabilizer.

It will be apparent that the length $L_1$ of the flame 38 is quite long, thus, in the FIG. 5 embodiment, the ring 30 has been replaced by a -ring 30A formed with an inner diameter $S_5$ which is about one half the throat diameter $S_4$ of the nozzle 12 and is significantly smaller than the inner diameter $S_3$ of the ring 30. The width of the space between the rings 20 and 30A has been increased relative to the dimension $S_2$ to dimension $S_6$ wherein $S_6$ is approximately equal to $S_5$ so that the flame height of flame 38A is significantly less than $L_1$ and the flames 34A and 38A have approximately the same lengths $L_3$ where $L_3$ is significantly smaller than $L_1$, slightly larger than $L_2$.

The outer ring 20 may be held in position in the opening passage 12 by any suitable means. In the illustrated arrangement it is held by a retaining wire 1, 2 and 3 connected to or extending across the upper outer end 18 of the burner 10 (see FIG. 2) and the inner ring 30 (or 30A) is suspended from the outer ring 20 by suitable wires or the like 4, 5 and 6. Any other suitable form of support may be used for supporting the stabilizers in position.

In the illustrated arrangement, the downstream ends 28 and 42 of the stabilizers have been aligned with the downstream end of the passage 12, i.e. with the end 18. This is the preferred arrangement although minor modifications, i.e. axial shifting relative to the direction of flow may be made, although it is important that the outer flow 24 remain close to the outer surface of the ring 20 which will not happen if the ring 20 is extended too far beyond the outlet end 18 and further to ensure flames are burning in free space which is best achieved with the downstream ends of the stabilizers slightly beyond the downstream end 18 of the nozzle 12. The optimum position is substantially as shown.

Figure 7:
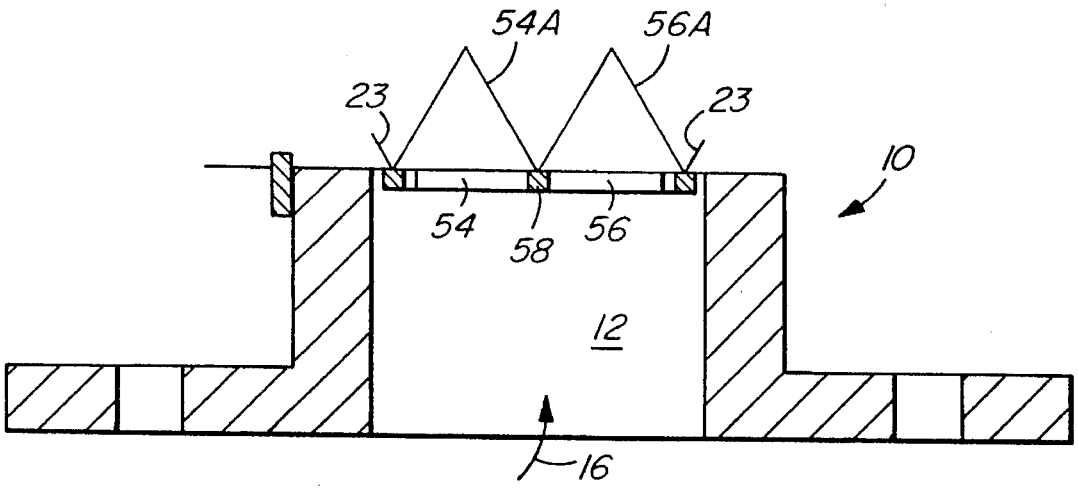
FIG. 7 is a section through a burner wherein the inner concentric ring has been replaced with elements which extend, in this case, substantially radically from the center.
Figure 8:
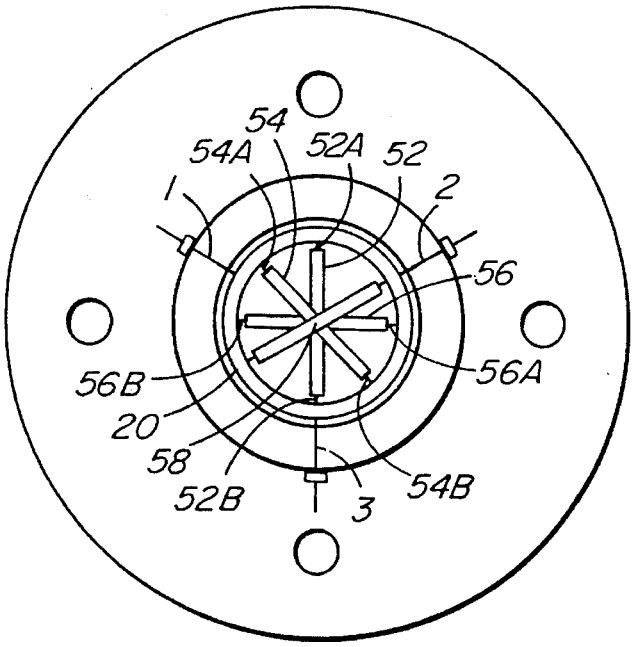
FIG. 8 is a plan view of the burner of FIG. 7.

In the FIGS. 7 and 8 embodiment, the inner concentric ring 30 or 30A has being replaced by a plurality of bars or rod elements 52, 54, 56 which in this embodiment extend substantially radially of the passage 12 and intersect at the centre as indicated at 58 and stabilize flames e.g. 54A and 56A. These bars 52, 54 and 56 are supported from their opposite ends via supporting wires extending from the ring 20 which is essentially the same as the ring 20 as in the previous embodiment. These supporting rods are indicated at 52A and 52B, 54A and 54B and 56A and 56B respectively.

It will be apparent that a single bar or rod stabilizer element may be used if desired, for example as single rod extending diagonally of the outer ring 20 and the manner in which the rings are supported may be varied, for example bar type stabilizers may be directly supported from the ring 20 or formed integral with ring 20 or 30 or both or the whole stabilizer means or system be formed for example by integrally interconnecting all of the bars and/or rings forming the stabilizer.

Figure 6:
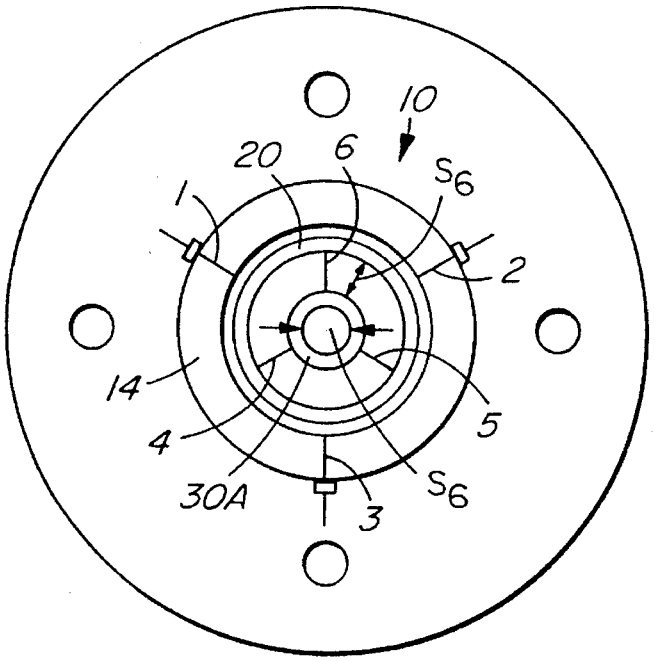
FIG. 6 is a plan view of the burner of FIG. 5.

The cross-sectional dimensions of these stabilizer bars or rods 52, 54 and 56 as above indicated, are essentially the same as the cross-section of the stabilizer ring 20, 30 or 30A and they function in essentially the same manner to form the required recirculation of hot gases from the combustion products of adjacent flames extending across the downstream ends of the stabilizers to provide ignition of the adjacent flows It will be apparent that the arrangement of the stabilizers may be adjusted or change to match with the flame shapes as desired and the combination of stabilizer such as shown in FIGS. 6 and 8 may be used in the arrangement shown in FIG. 1 or 3 or other arrangements of stabilizers may be used. For example, stabilizer rods may divide the flow inside of the ring 20 into a plurality of side by side flows, i.e. the bars or stabilizers would be parallel as opposed to traversing each other as shown in FIG. 6 or could be arranged to form a grid.

Generally the inner stabilizer elements e.g. inner ring 30 provide greater stability than the outer or peripheral ring 20 which is less effective due to the desire to maintain $S_1$ as small as practical, thus the inner stabilizer elements may be effective to reignite the flames adjacent the ring 20 and thereby the flame 23.

In all the examples shown the base of periphery of each of the subsidiary flames i.e. substantially the whole outer periphery of each of the subsidiary flows is defined by a stabilizer that generates recirculation flow continually igniting the adjacent flames.

EXAMPLE

Using a ring stabilized burner having a diameter of 32 mm a ring having dimension $W_1$=2 mm and a spacing $S_1$=0.8 mm, the flame height $L_1$ of the primary flame extending down the center of the burner was equal to and an axial length of 280 mm for burning lean mixtures at an equivalence ratio of 0.7.

Though this device was effective down to as low as 0.55 the flame height became very long rendering the system impractical for many installations.

A concentric ring burner was built according to the present invention wherein $S_1$ was 0.8 mm, $S_2$ was 8.3 mm and $S_3$ was 5.5 mm and $W_1$ and $W_2$ each were 2 mm.

In operating this burner with essentially the same gas fuel ratio and fuel mixture flow velocity through the burner (the burner being the same diameter as that used with the single ring stabilizer) the height of the flame $L_1$ was 95 mm and $L_2$ was 95 mm thereby clearly indicating that the flame height was significantly lower than that obtained with the rings closer together and illustrating that there is a direct relationship of the flame height to the dimensions of the base of the flame in this case, $S_2$ and $S_3$ which define the base of the flame.

It will be apparent that with the shorter flame length the lean gas burner may be used in place of the conventional burner and renders the system satisfactory for use in a conventional burner using fuel having an equivalence ratio of less than one preferably in the order of 0.75.

As above indicated the small flame 23 based on the flow 24 is the first to be extinguished, by providing a sensor 70 such as illustrated in FIG. 5 (could be applied to all embodiments) to sense the temperature for example to determine when the flame 23 is out, this information could be used to sound an alarm or otherwise control the burner operation.

Having described the invention, modifications will be evident to those skilled in the art without departing from the scope of the invention as defined in the appended claims.

We claim:

1. A burner for burning a flow of premix lean gaseous fuel mixtures having an equivalence ratio of less than one comprising a nozzle having an outer periphery defining a passage through which said flow passes, an outer ring stabilizer means positioned within said passage and spaced from said periphery to directly divide said flow of gaseous fuel mixture through said passage into a primary flow portion and a secondary flow portion, said secondary flow portion being adjacent to said periphery and being of significantly less volume than said primary flow portion, flame dividing stabilizer means positioned to divide said primary flow portion into a plurality of discrete subsidiary flow portions, each said subsidiary flow portion forming a subsidiary flame having a base dimension correlated with the desired maximum height of its subsidiary flame, said flame dividing stabilizer means having at least one stabilizer element arranged to define spaces through which said subsidiary flows pass and that correspond with and define said base dimensions of said subsidiary flame immediately downstream thereof, each said ring and said at least one flame stabilizer element having a blunt cross sectional shape to generate recirculating flows of hot product gases that extend across its downstream end, said recirculating flows continually igniting its adjacent subsidiary flows to stabilize its adjacent said flames.

2. A burner as defined in claim 1 wherein said at least one stabilizer element comprises at least one stabilizer bar extending transversely of said primary flow and dividing said primary flow into said subsidiary flows.

3. A burner as defined in claim 1 wherein said at least one stabilizer element comprises at least one annular stabilizer ring concentric with said outer stabilizer means and dividing said primary flow into at least two subsidiary flows.

4. A burner as defined in claim 3 wherein said at least one stabilizer element further comprise a plurality of stabilizer bars arranged in a pattern.

5. A burner as defined in claim 4 wherein said pattern is defined by at least one pair of said stabilizer bars intersecting.

6. A burner as defined in claim 5 wherein said stabilizer bars intersect adjacent to the midpoint of said primary flow.

7. A burner as defined in claim 1 wherein said at least one stabilizer element comprise a plurality of stabilizer bars arranged in a pattern.

8. A burner as defined in claim 7 wherein said pattern is defined by at least one pair of said stabilizer bars intersecting.

9. A burner as defined in claim 8 wherein said stabilizer bars intersect adjacent to the midpoint of said primary flow.

* * * * *